US009926816B2

(12) United States Patent
Ahmed et al.

(10) Patent No.: US 9,926,816 B2
(45) Date of Patent: Mar. 27, 2018

(54) SWITCHABLE ROCKER ARM WITH PIVOT JOINT

(71) Applicant: Schaeffler Technologies AG & Co. KG, Herzogenaurach (DE)

(72) Inventors: Faheem Ahmed, Troy, MI (US); Colin Foster, Belle River (CA); David Chandler, Windsor (CA); John Whitton, Milwaukee, WI (US); Kate Higdon, Royal Oak, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 83 days.

(21) Appl. No.: 15/198,978

(22) Filed: Jun. 30, 2016

(65) Prior Publication Data

US 2017/0009610 A1 Jan. 12, 2017

Related U.S. Application Data

(60) Provisional application No. 62/190,422, filed on Jul. 9, 2015, provisional application No. 62/295,341, filed on Feb. 15, 2016.

(51) Int. Cl.

| | |
|---|---|
| ***F01L 1/18*** | (2006.01) |
| ***F01L 1/24*** | (2006.01) |
| ***F01L 1/26*** | (2006.01) |
| ***F01L 13/00*** | (2006.01) |
| *F01L 1/46* | (2006.01) |

(52) U.S. Cl.

CPC ..... *F01L 1/2405* (2013.01); *F01L 1/18* (2013.01); *F01L 1/181* (2013.01); *F01L 1/24* (2013.01); *F01L 1/2411* (2013.01); *F01L 1/267* (2013.01); *F01L 13/0005* (2013.01); *F01L 2001/186* (2013.01); *F01L 2001/467* (2013.01)

(58) Field of Classification Search

CPC ... F01L 1/181; F01L 2001/186; F01L 1/2411; F01L 2001/467; F01L 13/0005

USPC ..... 123/90.46

See application file for complete search history.

(56) References Cited

U.S. PATENT DOCUMENTS 4,793,307 A * 12/1988 Quenneville ..... F01L 1/181 123/323

4,917,056 A * 4/1990 Yagi ..... F01L 1/143 123/198 F 5,544,626 A 8/1996 Diggs et al.

(Continued)

*Primary Examiner* — Jorge Leon, Jr.

(74) *Attorney, Agent, or Firm* — Matthew V. Evans

(57) ABSTRACT

A switchable rocker arm for valve deactivation is provided for a valve train of an internal combustion engine. The switchable rocker arm includes a cam lever assembly, a valve lever assembly, and a hydraulically actuated coupling assembly that is radially arranged between the cam lever and valve lever assemblies. The coupling assembly includes a shuttle pin, a locking pin with a round or flat locking interface, and optional shuttle pin and locking pin sleeves. In a first, locked position, the rotational motion of a camshaft is translated to linear motion of an engine valve. In a second, unlocked position, the cam lever assembly rotates about the valve lever assembly, facilitating valve deactivation. A pivot joint arranged between the cam lever and valve lever assemblies facilitates an arcuate lost motion of the cam lever assembly. An integrated arrangement for one or more lost motion springs offers packaging and functional advantages.

20 Claims, 9 Drawing Sheets

(56) References Cited

U.S. PATENT DOCUMENTS

| | | | | |
|---|---|---|---|---|
| 6,532,920 | B1 | 3/2003 | Sweetnam et al. | |
| 7,363,894 | B2 | 4/2008 | Evans et al. | |
| 7,882,814 | B2 | 2/2011 | Spath et al. | |
| 8,915,225 | B2 | 12/2014 | Zurface et al. | |
| 2014/0182528 | A1* | 7/2014 | Jeon | F01L 1/181 123/90.12 |

* cited by examiner

SWITCHABLE ROCKER ARM WITH PIVOT JOINT

INCORPORATION BY REFERENCE

The following documents are incorporated herein by reference as if fully set forth: U.S. Provisional Application No. 62/190,422, filed Jul. 9, 2015 and U.S. Provisional Application No. 62/295,341, filed Feb. 15, 2016.

TECHNICAL FIELD

Example aspects described herein relate to switchable rocker arms that facilitate multiple discrete engine valve lift events for an internal combustion (IC) engine.

BACKGROUND

More stringent fuel economy regulations in the transportation industry have prompted the need for improved efficiency of the IC engine. Light-weighting, friction reduction, thermal management, variable valve timing and a diverse array of variable valve lift (VVL) technologies are all part of the technology toolbox for IC engine designers.

VVL systems typically employ a technology in a valve train of an IC engine that allows different engine valve lifts to occur. The valve train consists of the components that are required to actuate an engine valve, including a camshaft, the valve, and all components that lie in between. VVL systems are typically divided into two categories: continuous variable and discrete variable. Continuous variable valve lift systems are capable of varying a valve lift from a design lift minimum to a design lift maximum to achieve any of several lift heights. Discrete variable valve lift systems are capable of switching between two or three distinct valve lifts. Components that enable these different valve lift modes are often called switchable valve train components. Typical two-step discrete valve lift systems switch between a full valve lift mode and a partial valve lift mode, often termed cam profile switching, or between a full valve lift mode and a no valve lift mode that facilitates deactivation of the valve. Valve deactivation can be applied in different ways. In the case of a four-valve-per-cylinder configuration (two intake+two exhaust), one of two intake valves can be deactivated. Deactivating only one of the two intake valves can provide for an increased swirl condition that enhances combustion of the air-fuel mixture. In another scenario, all of the intake and exhaust valves are deactivated for a selected cylinder which facilitates cylinder deactivation. On most engines, cylinder deactivation is applied to a fixed set of cylinders, when lightly loaded at steady-state speeds, to achieve the fuel economy of a smaller displacement engine. A lightly loaded engine running with a reduced amount of active cylinders requires a higher intake manifold pressure, and, thus, greater throttle plate opening, than an engine running with all of its cylinders in the active state. Given the lower intake restriction, throttling losses are reduced in the cylinder deactivation mode and the engine runs with greater efficiency. For those engines that deactivate half of the cylinders, it is typical in the engine industry to deactivate every other cylinder in the firing order to ensure smoothness of engine operation while in this mode. Deactivation also includes shutting off the fuel to the dormant cylinders. Reactivation of dormant cylinders occurs when the driver demands more power for acceleration. The smooth transition between normal and partial engine operation is achieved by controlling ignition timing, cam timing and throttle position, as managed by the engine control unit (ECU). Examples of switchable valve train components that serve as cylinder deactivation facilitators include roller lifters, pivot elements, rocker arms, roller finger followers, and camshafts; each of these components is able to switch from a full valve lift mode to a no valve lift mode. The switching of lifts occurs on the base circle or non-lift portion of the camshaft; therefore the time to switch from one mode to another is limited by the time that the camshaft is rotating through its base circle portion; more time for switching is available at lower engine speeds and less time is available at higher engine speeds. Maximum switching engine speeds are defined by whether there is enough time available on the base circle portion to fully actuate a locking mechanism to achieve the desired lift mode.

In today's IC engines, many of the switchable valve train components that enable valve deactivation for cylinder deactivation contain a coupling assembly that is actuated by an electro-hydraulic system. The electro-hydraulic system typically contains at least one solenoid valve within an array of oil galleries that manages engine oil pressure to either lock or unlock the coupling assembly within the switchable valve train component to enable a valve lift switching event. These types of electro-hydraulic systems require time within the combustion cycle to actuate the switchable valve train component.

In most IC engine applications, switchable valve train components for cylinder deactivation in an electro-hydraulic system are classified as "pressureless-locked", which equates to:

a). In a no or low oil pressure condition, the spring-biased coupling assembly will be in a locked position, facilitating the function of a standard valve train component that translates rotary camshaft motion to linear valve motion; and, b). In a condition in which engine oil pressure is delivered to the coupling assembly that exceeds the force of the coupling assembly bias spring, the coupling assembly will be displaced a given stroke to an unlocked position, facilitating valve deactivation where the rotary camshaft motion is not translated to the valve.

"Pressureless-unlocked" electro-hydraulic systems can be found in some cam profile switching systems that switch between a full valve lift and a partial valve lift, which equates to:

a). In a no or low oil pressure condition, the spring-biased coupling assembly will be in an unlocked position, facilitating a partial valve lift event; and, b). In a condition in which engine oil pressure is delivered to the coupling assembly that exceeds the force of the coupling assembly bias spring, the coupling assembly will be displaced a given stroke to a locked position, facilitating a full valve lift event.

Switchable valve train systems often contain a lost motion spring or springs that provide a force during the unlocked mode to a component of the switchable valve train component assembly that is actuated by the camshaft, but does not translate rotary camshaft motion to linear valve lift. In many shaft-mounted switchable rocker arm systems, the lost motion spring is housed within a cylinder head or valve cover which can create packaging challenges. The lost motion spring provides a force that maintains contact between the actuated component and camshaft up to a maximum unlocked mode engine speed. FIGS. 15 and 16 show a prior art switchable rocker arm 100 for cylinder deactivation with a lost motion spring 150 that interfaces with the switchable rocker arm 100. A cam lever assembly 110 and a valve lever assembly 120 together form the switchable rocker arm 100. The cam lever assembly 110 is actuated by the camshaft 160 during the unlocked mode and interfaces with the lost motion spring 150 through a lost motion interface 190. With the shown position of the lost motion interface 190, a housing for the lost motion spring 150 is typically present above the switchable rocker arm 100, possibly in a valve cover or cylinder head cover (not shown). An alternative lost motion interface 190' on the opposite end of the cam lever assembly 110 would also be possible, which would likely move the lost motion spring housing to a position below the switchable rocker arm 100 within the cylinder head (not shown). For both described locations of the lost motion spring 150, packaging space to house the lost motion spring 150 is required in an already packaging-challenged cylinder head environment of an internal combustion engine. Therefore, a switchable rocker arm with an integrated lost motion spring (or springs) that offers a smaller packaging space would be desirable.

While the cam lever assembly 110 is actuated by a full lift cam lobe 180 of a camshaft 160 during an unlocked mode, the valve lever assembly 120 remains stationary. For proper locking and unlocking of the cam lever assembly 110 to the valve lever assembly 120, rotational alignment of the two lever assemblies 110,120 and respective coupling assembly interfaces must be ensured during the base circle portion of the rotating camshaft. While rotational position and control of the cam lever assembly 110 is managed by the camshaft and lost motion spring 150 during the unlocked mode, proper rotational position of the valve lever assembly 120 is provided by an engine valve (not shown) at one end and a camshaft abutment 140 that interfaces with a zero-lift or base circle lobe 170 of the camshaft 160 on the opposite end. The camshaft abutment 140 can be especially helpful in switchable rocker arm designs, such as the one shown in FIGS. 14 and 15, that utilize a hydraulic lash adjuster 130 within the valve lever assembly 120. During the unlocked mode a pump-up condition can occur, in which the incoming oil pressure causes the hydraulic lash adjuster 130 to expand since it is not subjected to a normal valve actuation load. The camshaft abutment 140 can serve as a pump-up inhibitor, limiting the rotation of the valve lever assembly 120 due to pump-up of the hydraulic lash adjuster 130. However, the camshaft abutment 140 can be a source of undesirable friction and wear and requires the presence and corresponding cost of the base circle lobe 170 on the camshaft 160. Therefore, a switchable rocker arm that does not require the presence of a camshaft abutment and a corresponding base circle lobe on a camshaft would be desirable.

The packaging space required for the prior art switchable rocker arm 100 shown in FIGS. 15 and 16 must also take into account an arcuate lost motion of the cam lever assembly 110 during an unlocked mode as shown by the arrow within FIG. 16. In many cylinder head environments, this arcuate lost motion can lead to an interference condition with either the cylinder head itself or other assembled components within the cylinder head. Therefore, a switchable rocker arm that offers minimal lost motion packaging implications would be desirable.

Given the described packaging and corresponding cost challenges of implementing the prior art shaft-mounted switchable rocker arm within an IC engine, example embodiments will now be described that offer solutions for lost motion spring and arcuate lost motion packaging along with elimination of the camshaft abutment.

SUMMARY OF THE INVENTION

A switchable rocker arm for valve deactivation is provided for a valve train of an internal combustion engine. The switchable rocker arm includes a cam lever assembly, a valve lever assembly, and a hydraulically actuated coupling assembly that is radially arranged between the cam lever and valve lever assemblies. The coupling assembly includes a shuttle pin, a locking pin, and a resilient element or spring that acts on the locking pin. In a first, locked position, the rotational motion of a camshaft is translated to linear motion of an engine valve. In a second, unlocked position, the cam lever assembly rotates about the valve lever assembly, facilitating valve deactivation. Lost motion of the cam lever assembly is guided by a first curved surface on the valve lever assembly that rotationally guides a second curved surface on the cam lever assembly. An overswing or first rotational stop is arranged at a first end of the first curved surface on the valve lever assembly. A transport or second rotational stop can be arranged at a first end of a third curved surface configured on the valve lever assembly, such that the cam lever assembly can rotate a pre-determined angle in the second unlocked position.

The cam lever assembly is configured with first and second arms that extend along opposed sides of the cam lever assembly. The first arm has a second rocker shaft bore and the second arm has a third rocker shaft bore. A first rocker shaft bore on a first end of the valve lever assembly is axially aligned with the second and third rocker shaft bores on the cam lever assembly.

Various forms of valve interfaces can be arranged on a second end of the valve lever assembly, including a hydraulic lash adjuster assembly or an adjustment screw assembly. In addition, various forms of camshaft interfaces can be arranged on a cam interface end of the cam lever assembly, including a roller follower or a slider pad.

Several variations of the coupling assembly are possible to accommodate different material selections and manufacturing processes. The locking pin can be disposed within a second radial aperture within the cam lever assembly that serves as a locking pin bore. Alternatively, a locking pin sleeve of suitable material and hardness to accommodate durability requirements can be arranged within the second radial aperture of the cam lever assembly to serve as the locking pin bore. The locking pin can have a round cross-section throughout its length or configured with an optional first radial flat on an outer radial surface of the first end. The presence of the first radial flat requires anti-rotation accommodations for the locking pin. Various forms of anti-rotation restraints that guide the first radial flat are possible, including a restraint that is transverse to the locking pin. A bearing needle or similar can be utilized as an anti-rotation restraint. A locking interface for the locking pin, provided by a radial shuttle pin bore within the valve lever assembly, can be of various forms. The shuttle pin bore, in fluid communication with the first rocker shaft bore, can be in the form of a first radial aperture within the valve lever assembly. The shuttle pin bore can be round throughout its length or contain a flat to interface with the locking pin. A locking pin landing, having a convex quadrilateral cross-section, can be transversely disposed within the shuttle pin bore to serve as an interface for the optional first radial flat on the locking pin. Alternatively, a shuttle pin sleeve of suitable material and hardness can be arranged within the first radial aperture of the valve lever assembly to serve as the shuttle pin bore and locking pin interface. The shuttle pin sleeve can be configured with a second radial flat on an inner radial surface to receive the optional first radial flat of the locking pin. The second radial flat can extend throughout the length of the shuttle pin sleeve or to a medial distance within the sleeve.

In the first, locked position of the coupling assembly, the radial locking pin bore is axially aligned with the radial shuttle pin bore and the locking pin is arranged partially within each of the bores. In the second, unlocked position of the coupling assembly, the locking pin is disengaged from the shuttle pin bore, permitting relative motion of the cam lever assembly relative to the valve lever assembly. A resilient element formed as a spring is in contact with the locking pin at the first, locked and the second, unlocked positions. In the first, locked position, the spring has a first compressed length and in the second, unlocked position, the spring has a second compressed length. The first compressed length is greater than the second compressed length.

BRIEF DESCRIPTION OF DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
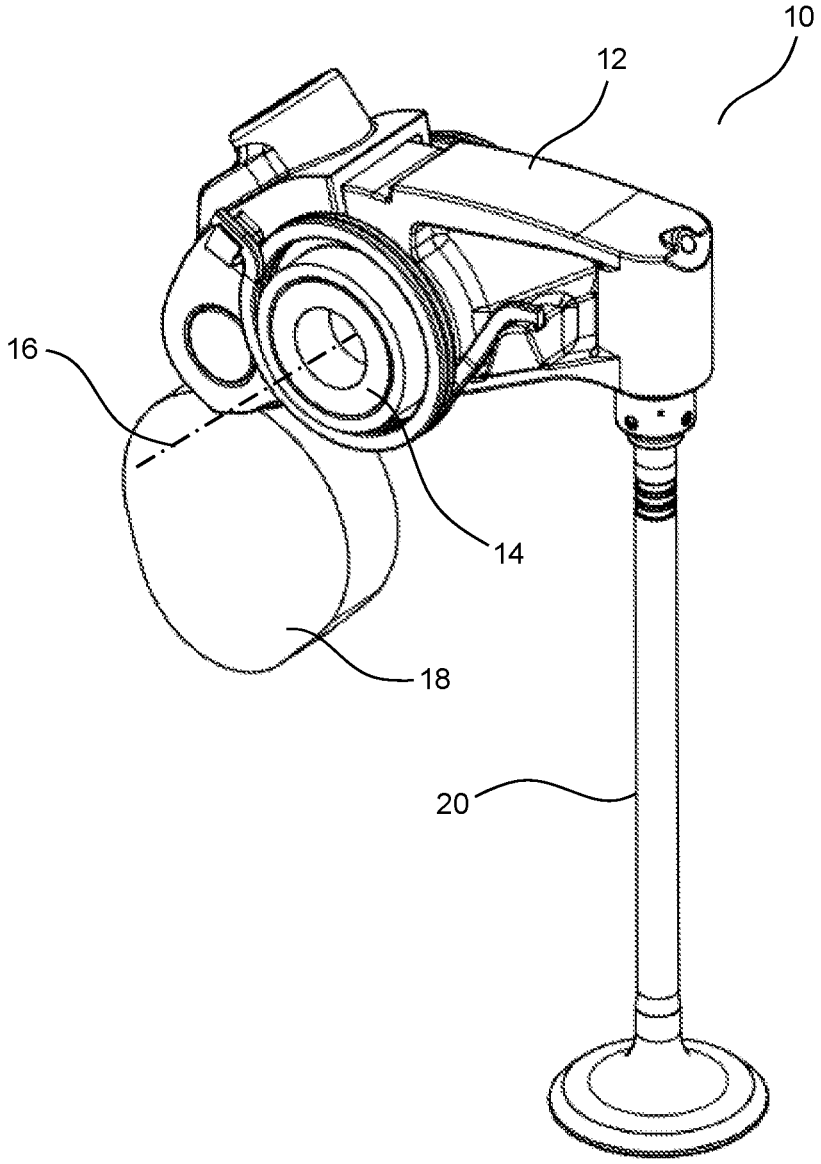
FIG. 1 is a perspective view of a first example embodiment of a switchable rocker arm within a valve train system of an IC engine.
Figure 2:
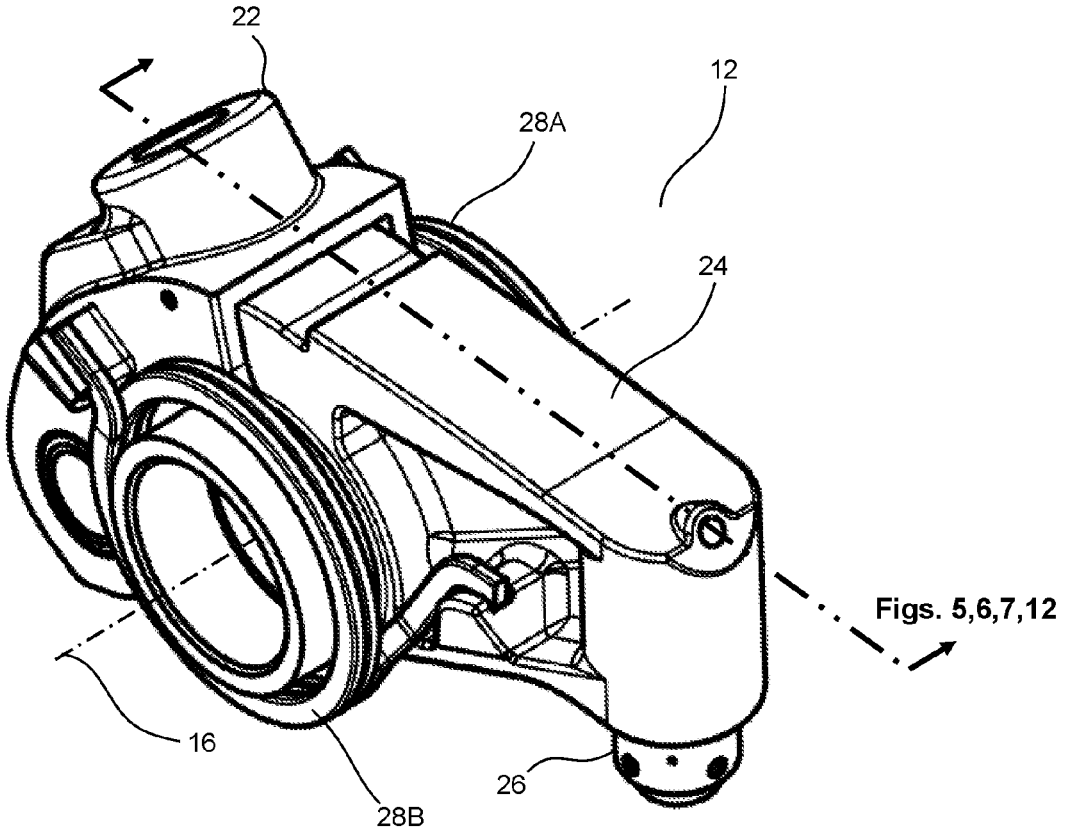
FIG. 2 is a perspective view of the switchable rocker arm of FIG. 1.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. A radially inward direction is from an outer radial surface of the outer raceway, toward the central axis or radial center of the outer raceway. Conversely, a radial outward direction indicates the direction from the central axis or radial center of the outer raceway toward the outer surface. Axially refers to directions along a diametric central axis. The words "left" and "right" designate directions in the drawings to which reference is made.

Referring to FIG. 1, a perspective view of a switchable rocker arm 12 is shown within a valve train system 10 of an IC engine that includes a rocker shaft 14, a camshaft 18, and an engine valve 20. The camshaft 18 rotationally actuates the switchable rocker arm 12 about the rocker shaft 14 or central axis 16, causing rotational lift of the camshaft 18 to be translated to linear lift of the valve 20.

Referring to FIGS. 1 through 8, a detailed explanation of the design and function of the switchable rocker arm 12 now follows. The switchable rocker arm 12 is comprised of a valve lever assembly 24 and a cam lever assembly 22. The valve lever assembly 24 is configured with a first rocker shaft bore 34 at a first end and an optional hydraulic lash adjuster assembly 26 at a second end. An optional hydraulic lash adjuster fluid gallery 62 extends from the first rocker shaft bore 34 to the optional hydraulic lash adjuster assembly 26. Concentric to the first rocker shaft bore 34 is a first curved surface 30. Extending from the first curved surface 30 is a first radial aperture 41. A shuttle pin sleeve 50 that includes a shuttle pin bore 53 is disposed within the first radial aperture 41. A shuttle pin fluid gallery 64 extends from the first rocker shaft bore 34 to the shuttle pin bore 53, providing fluid communication from the first rocker shaft bore 34 to the shuttle pin bore 53. A shuttle pin 52 is disposed within the shuttle pin bore 53 and is actuated by fluid delivered from the first rocker shaft bore 34 (arriving via the rocker shaft 14) to the shuttle pin bore 53. The cam lever assembly 22 includes a roller follower 48 attached by an axle pin 46 to a cam interface end. The cam lever assembly 22 is also configured with a first arm 36A and a second arm 36B that extend along opposed sides of the valve lever assembly 24. The first arm 36A has a second rocker shaft bore 38 and the second arm 36B has a third rocker shaft bore 40. The second and third rocker shaft bores 38,40 of the cam lever assembly 22 are axially aligned with the first rocker shaft bore 34 of the valve lever assembly 24. The cam lever assembly 22 includes a second curved surface 44 and a second radial aperture 43 that extends from the second curved surface 44. A locking pin sleeve 54 that includes a locking pin bore 55 is disposed within the second radial aperture 43. A locking pin 56 is disposed within the locking pin bore 55. A first end of the locking pin 56 is engaged and actuated by the shuttle pin 52 and the opposite end of the locking pin 56 is in contact with a locking pin resilient element or bias spring 58. Various positions of the shuttle pin 52 and locking pin 56 that correspond with different valve lift modes will now be described.

Figure 5:
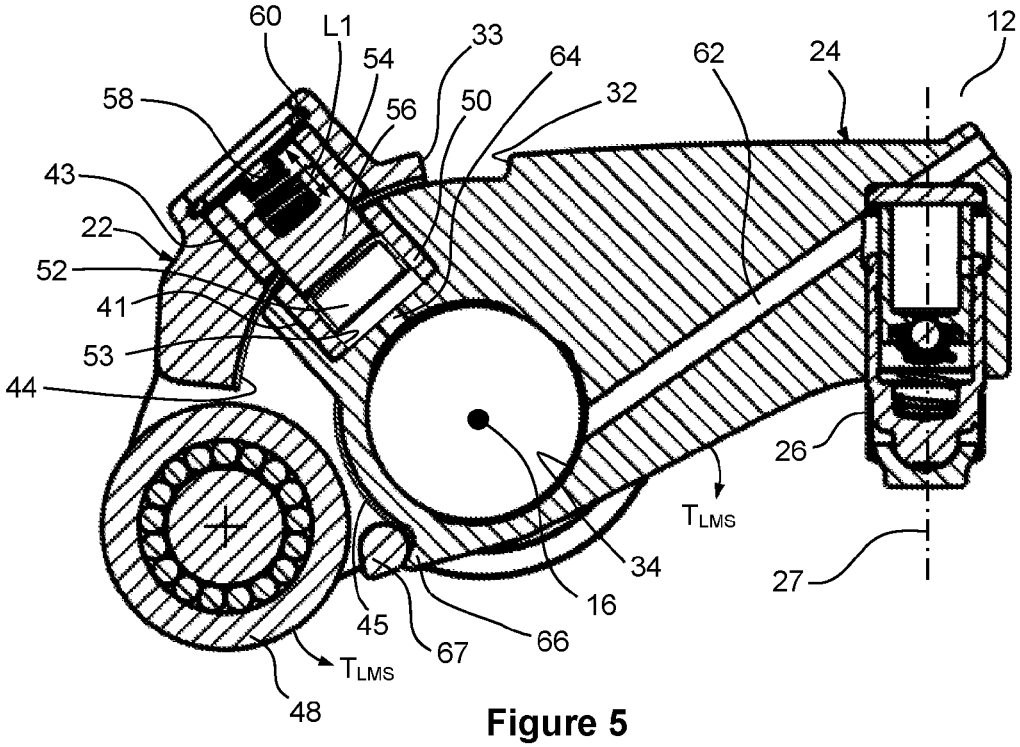
FIG. 5 is a cross-sectional view taken from FIG. 2.

Referring to FIG. 5, the switchable rocker arm 12 is shown in a first, locked position. In this first, locked position, the locking pin bore 55 is axially aligned with the shuttle pin bore 53 and the locking pin 56 is arranged partially within the shuttle pin bore 53 and partially within the locking pin bore 55. The locking pin bias spring 58 is shown at a first compressed length L1. With this position of the locking pin 56, rotation of the cam lever assembly 22 about central axis 16 causes rotation of the valve lever assembly 24 and linear motion of the engine valve 20. Therefore, the first, locked position defines a full valve lift mode.

Figure 6:
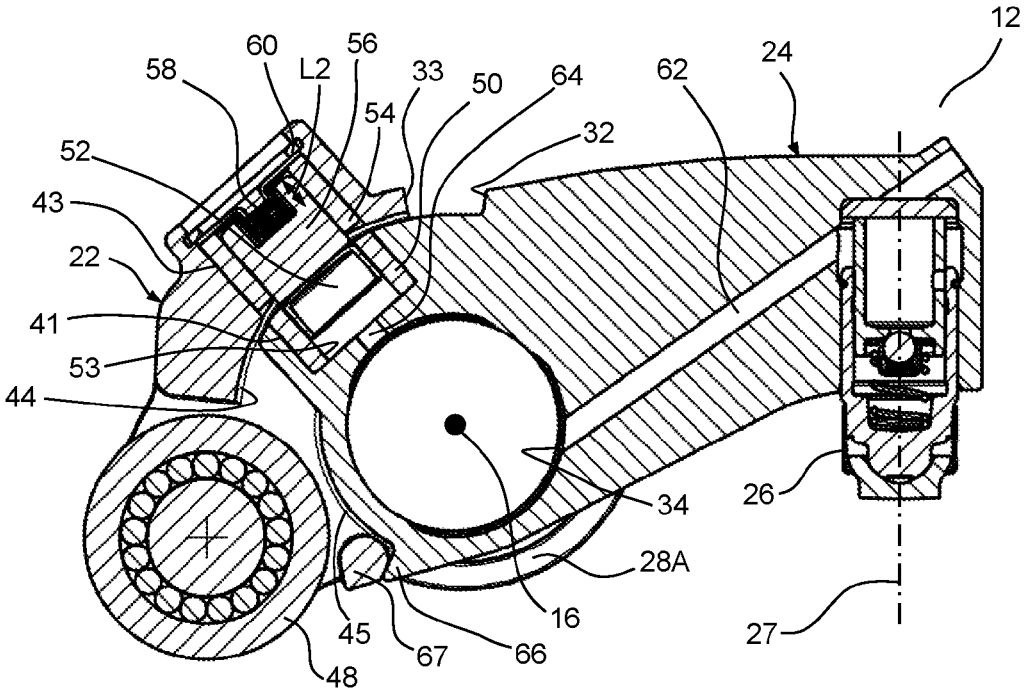
FIG. 6 is a cross-sectional view taken from FIG. 2.

Referring now to FIG. 6, the switchable rocker arm 12 is shown in a second, unlocked position in which the locking pin 56 is disengaged from the shuttle pin bore 53. This position of the locking pin 56 occurs when the force of the fluid pressure acting on the shuttle pin 52 (arriving via the shuttle pin fluid gallery 64) overcomes the force of the bias spring 58 acting on the locking pin 56. In the second, unlocked position, the locking pin bias spring 58 compresses to a second compressed length L2, which is less than the first compressed length L1 of the first, locked position. Upon rotation of the cam lever assembly 22 about central axis 16, the valve lever assembly 24 does not rotate, thereby, preventing linear motion of the engine valve 20. The second, unlocked position defines a no valve lift or deactivated valve mode. As the cam lever assembly 22 rotates or pivots relative to the valve lever assembly 24, the second curved surface 44 on the cam lever assembly 22 is rotationally guided by the first curved surface 30 on the valve lever assembly 24, representative of a curved pivot joint. Overlap of the first curved surface 30 by the second curved surface 44 becomes greater as the cam lever assembly 22 is actuated further by the camshaft 18. Additional packaging space for the pivoting of the cam lever assembly 22 while in the second, unlocked position is not required. Therefore, the packaging space required to accommodate the pivoting of the cam lever assembly 22 of the switchable rocker arm 12 while in the deactivated valve mode is not greater than the packaging space required for the switchable rocker arm 12 while in the full valve lift mode.

Figure 7:
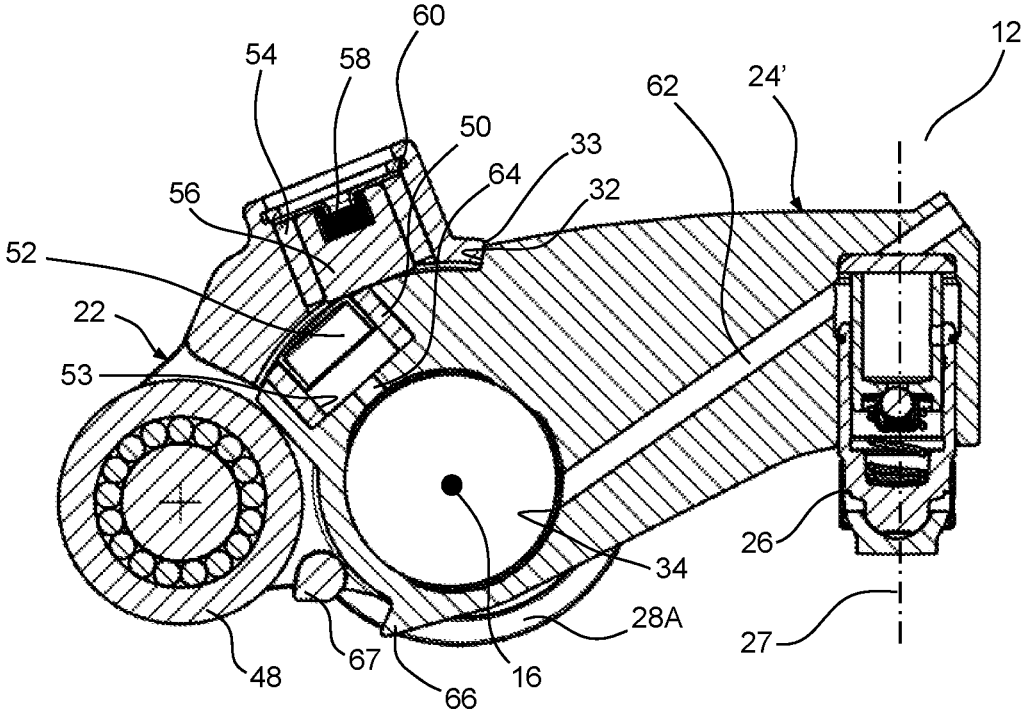
FIG. 7 is a cross-sectional view taken from FIG. 2.

The rotation of the cam lever assembly 22 relative to the valve lever assembly 24 is limited by features that are formed on ends of the first and second curved surfaces 30,44. A first rotational stop 32 is present at a first end of the first curved surface 30 of the valve lever assembly 24, while a first abutment 33 is present at an abutment end of the second curved surface 44 of the cam lever assembly 22. Contact between the first rotational stop 32 with the first abutment 33 is shown in FIG. 7.

Figure 3:
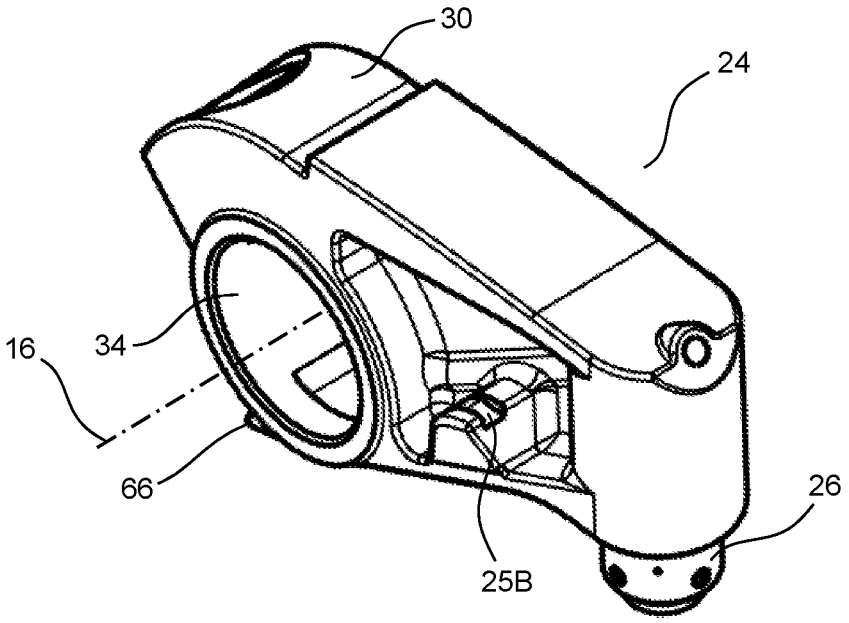
FIG. 3 is a perspective view of a valve lever assembly of the switchable rocker arm of FIG. 2.
Figure 4:
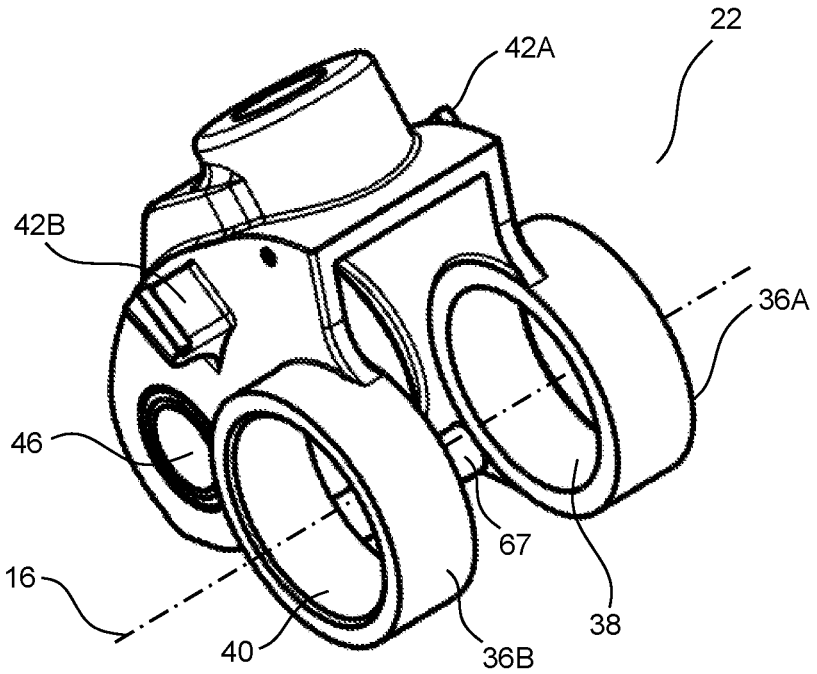
FIG. 4 is a perspective view of a cam lever assembly of the switchable rocker arm of FIG. 2.

Now referring to FIGS. 1 through 4, additional components and design features of the switchable rocker arm 12 will now be described. While in the second, unlocked position, the rotational motion of the cam lever assembly 22 with respect to the valve lever assembly 24 is often termed "lost motion" which facilitates deactivation of the engine valve 20. A first lost motion spring 28A and a second lost motion spring 28B are arranged between the cam lever assembly 22 and the valve lever assembly 24 to provide a force that, a). Prevents separation between the cam lever assembly 22 and the camshaft 18 up to a maximum deactivation engine speed, and, b). Acts upon the valve lever assembly 24, such that a portion of the spring force is translated along a central axis 27 of the hydraulic lash adjuster 26 to prevent a pump-up condition. Special design features configured within the cam and valve lever assemblies 22,24 are present to interface with the ends of the first and second lost motion springs 28A,28B. The valve lever assembly 24 includes first and second lost motion spring landings 25A,25B (only 25B is shown in FIG. 3), while the cam lever assembly 22 includes first and second lost motion spring retainer posts 42A,42B. For these lost motion interface features on the cam and valve lever assemblies 22,24, any suitable forms can be utilized and not just the ones illustrated in the figures. Additionally, a single lost motion spring could be utilized instead of two lost motion springs.

The arrangement of the first and second lost motion springs 28A,28B within the first and second lost motion spring landings 25A,25B and the first and second lost motion spring retainer posts 42A,42B induces a rotational torque $T_{LMS}$ on each of the cam lever and valve lever assemblies 22,24, as shown in FIG. 5. A second rotational stop 66 can be configured within the valve lever assembly 24 and a second abutment 67 can be configured within the cam lever assembly 22 to abut with the second rotational stop 66 and limit relative rotation due to the rotational torque $T_{LMS}$. As shown in FIG. 5, the second rotational stop 66 is arranged at a first end of a third curved surface 45 configured on the valve lever assembly 24, however, any suitable location for the second rotational stop 66 can be utilized. The angular rotation of the cam lever assembly 22 between the second rotational stop 66 and the previously described first rotational stop 32 can typically accommodate the full angular range of rotation of the cam lever assembly 22 as it is actuated by the camshaft 18 while the switchable rocker arm 12 is in the second, unlocked position. Alternatively stated, the angular distance between the first rotational stop 32 and second rotational stop 66 can typically accommodate a pre-determined lost motion stroke required to deactivate the engine valve 20.

The previously described arrangement of the lost motion springs 28A,28B within the switchable rocker arm 12 offers two distinct design advantages: a). Elimination of an external housing within the cylinder head or valve cover for one or more lost motion springs; and, b). Elimination of a camshaft abutment feature to ensure the proper rotational location of the cam lever assembly 22 while in the second, unlocked position.

Figure 9:
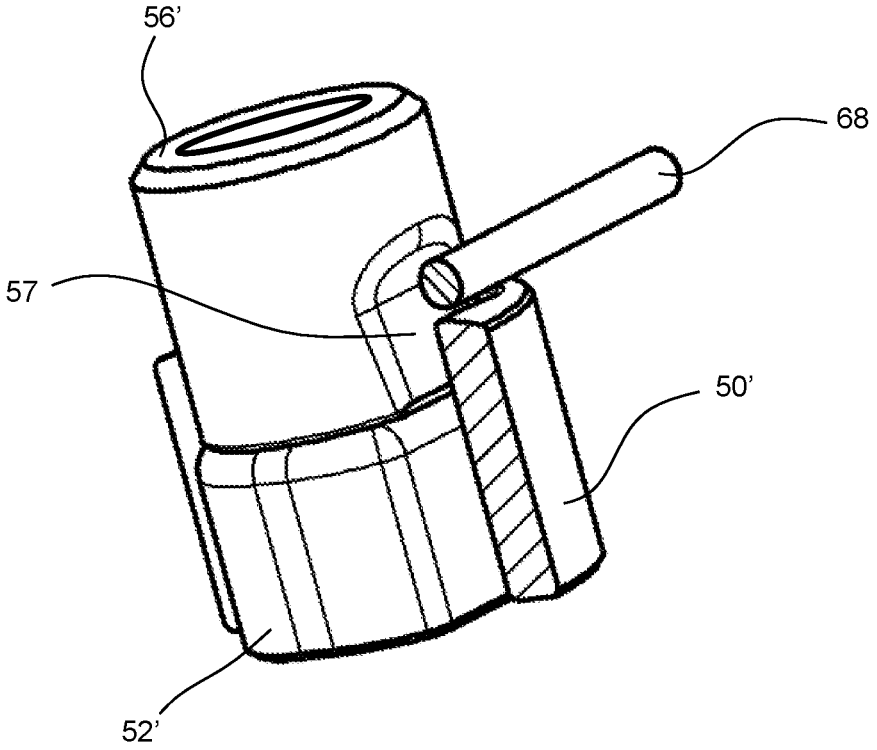
FIG. 9 is a perspective view of an example embodiment of a coupling assembly.
Figure 10A:
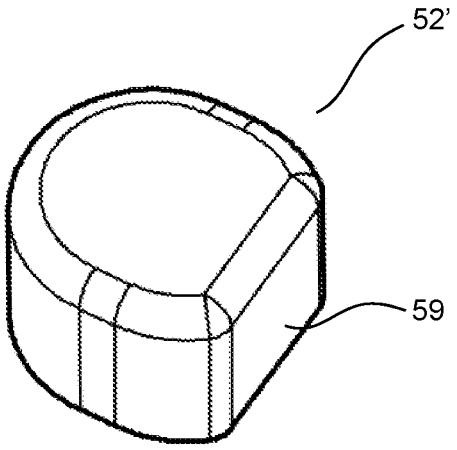
FIG. 10A is a perspective view of a shuttle pin of the coupling assembly of FIG. 9.
Figure 10B:
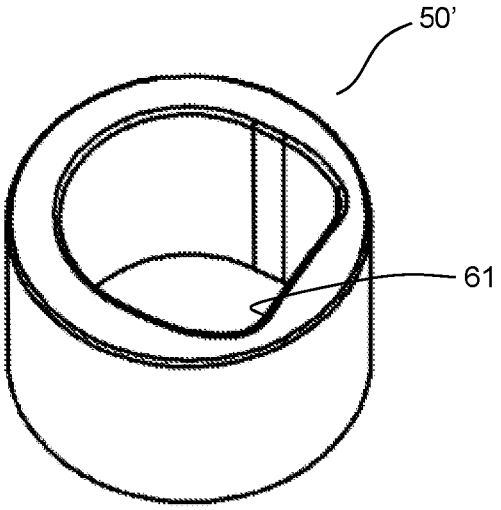
FIG. 10B is a perspective view of a shuttle pin sleeve of the coupling assembly of FIG. 9.

Now referring to FIGS. 9 through 10B, an additional embodiment for a coupling assembly is shown that includes a locking pin 56', a shuttle pin 52', a shuttle pin sleeve 50' and a locking pin anti-rotation restraint 68. The locking pin 56' includes a first radial flat 57 on an outer radial surface of a first end to serve as a load interface. Optionally, the first radial flat 57 can be tapered such as that described in U.S. Pat. No. 7,055,479. The shuttle pin sleeve 50' includes a second radial flat 61 arranged on the shuttle pin bore that spans the entire length of the shuttle pin sleeve 50' and interfaces with the first radial flat 57 of the locking pin 56'. The first radial flat 57 is guided by the locking pin anti-rotation restraint 68 to ensure proper alignment of the first radial flat 57 with the second radial flat 61 during displacement of the locking pin 56' from either of the first, locked or second, unlocked positions. The anti-rotation restraint 68 can be in the form of a needle roller or any other suitable form to provide anti-rotation. The shuttle pin 52' shown in FIGS. 9 and 10A includes a third radial flat 59 to accommodate the continuous second radial flat 61 that is present on the shuttle pin bore of the shuttle pin sleeve 50'.

Figure 8:
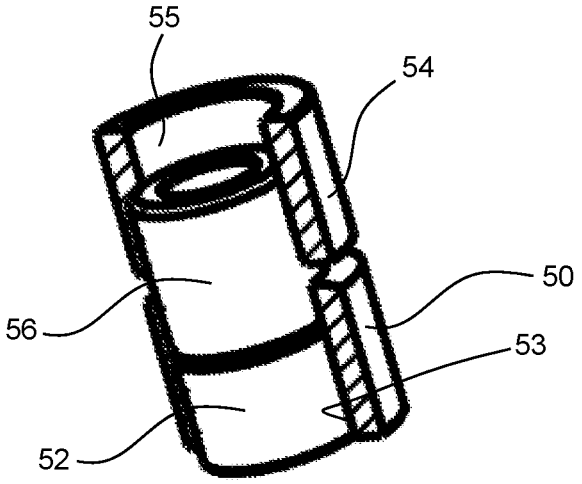
FIG. 8 is a perspective view of a coupling assembly of the switchable rocker arm of FIGS. 5, 6 and 7.
Figure 11A:
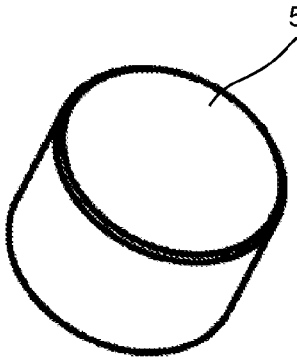
FIG. 11A is a perspective view of an example embodiment of a shuttle pin.
Figure 11B:
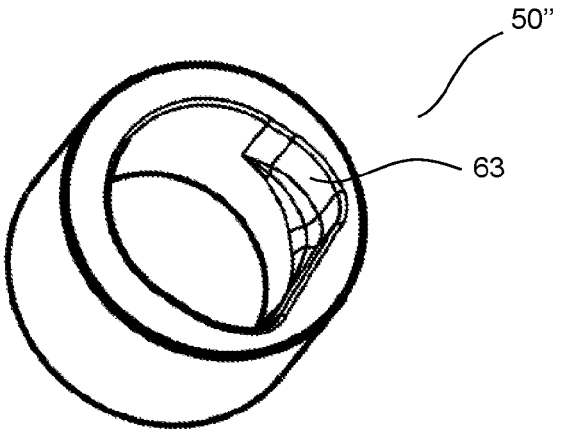
FIG. 11B is a perspective view of an example embodiment of a shuttle pin sleeve.
Figure 12:
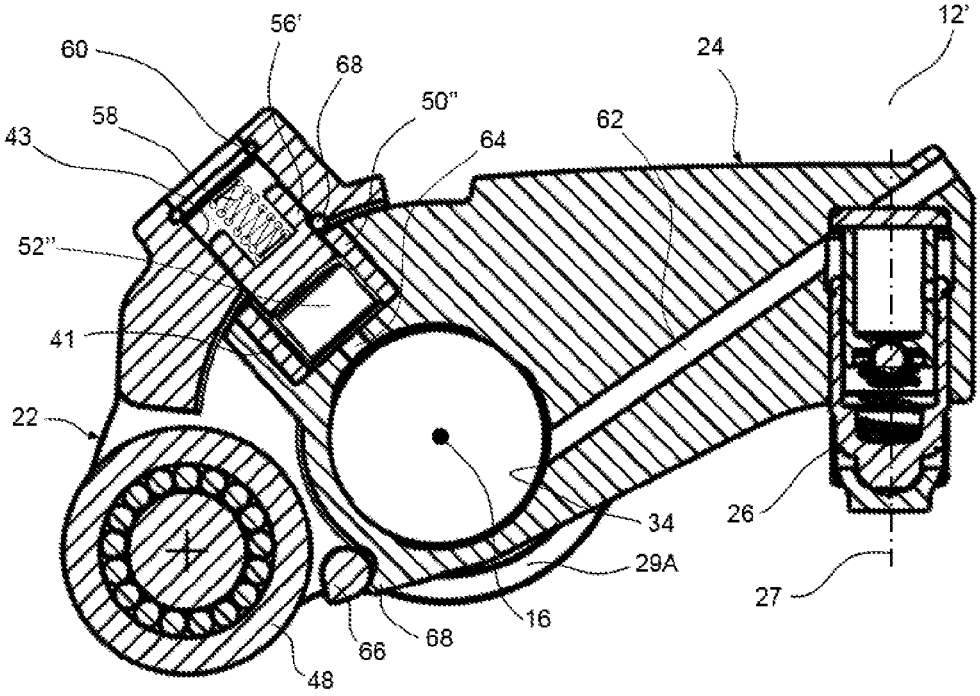
FIG. 12 is a cross-sectional view taken from FIG. 2 showing the coupling assembly of FIG. 9.

FIGS. 11A, 11B and 12 show an example embodiment of a coupling assembly that maintains use of the previously described locking pin 56' and corresponding locking pin anti-rotation restraint 68. In this example embodiment, the shuttle pin sleeve 50" includes a blind flat or a second radial flat 63 that extends from a first end to a medial position on the shuttle pin sleeve 50". With the implementation of the blind flat 63, a round shuttle pin 52" can be utilized instead of a shuttle pin with a radial flat. This design solution for the shuttle pin 52" and sleeve 50" may provide cost savings due to reduced manufacturing complexity of one or both components. Implementation of this coupling assembly example embodiment is shown within the switchable rocker arm 12' of FIG. 12. It should be noted that this coupling assembly variation is shown without a locking pin sleeve, as the second radial aperture 43 of the cam lever assembly 22 can be configured with the appropriate form to serve as a locking pin bore. However, it would also be possible to implement a locking pin sleeve as shown in FIG. 8 within the coupling assembly shown in FIG. 9.

Figure 13:
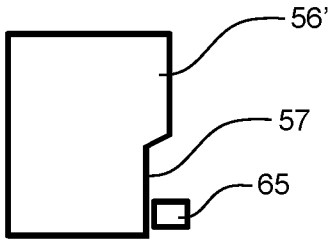
FIG. 13 is a side view of an alternative locking interface for a locking pin.

Instead of implementing the shuttle pin sleeves 50,50',50" for the previously described coupling assemblies that are disposed within the first radial aperture 41 of the valve lever assembly 24, the first radial aperture 41 can be configured with the appropriate form to serve as a shuttle pin bore. Such an appropriate form can be achieved by a multitude of processes such as machining, powdered metal, or metal injection molding. Optionally, referring now to FIG. 13, the appropriate locking interface for the locking pin 56' with the first radial flat 57 may be achieved by a locking pin landing 65 having a convex quadrilateral cross-section that is transversely disposed within the first radial aperture 41 (not shown in FIG. 13) to receive the first radial flat 57 of the locking pin 56'.

Figure 14:
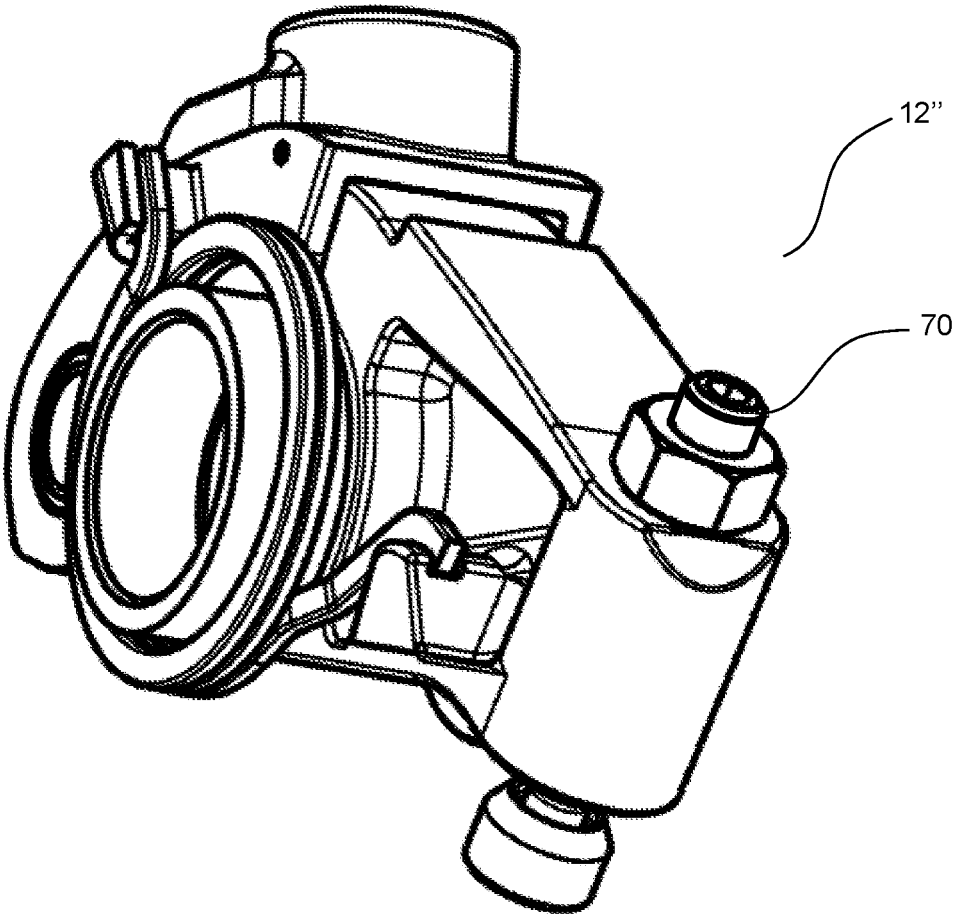
FIG. 14 is a perspective view of a switchable rocker arm with an alternative valve interface.
Figure 15:
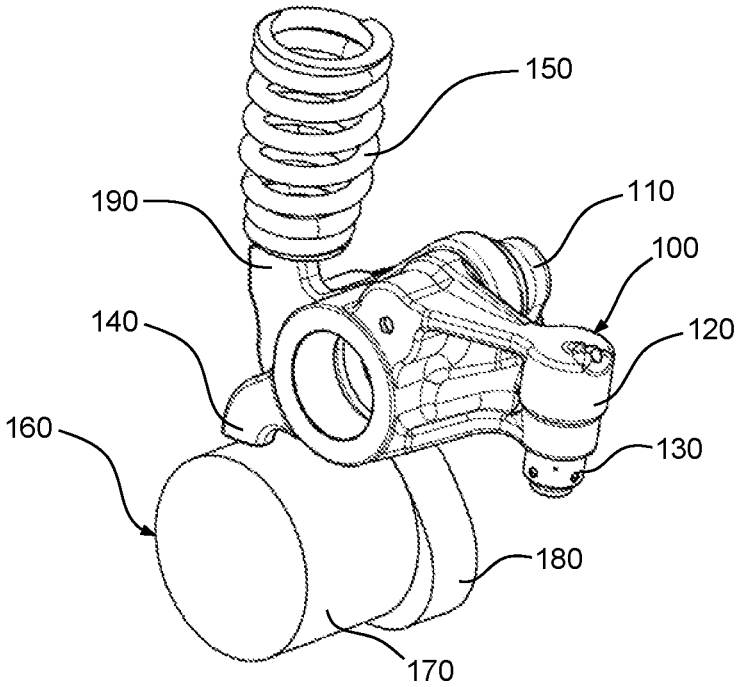
Figure 15 PRIOR ART
FIG. 15 is a perspective view of a prior art switchable rocker arm.
Figure 16:
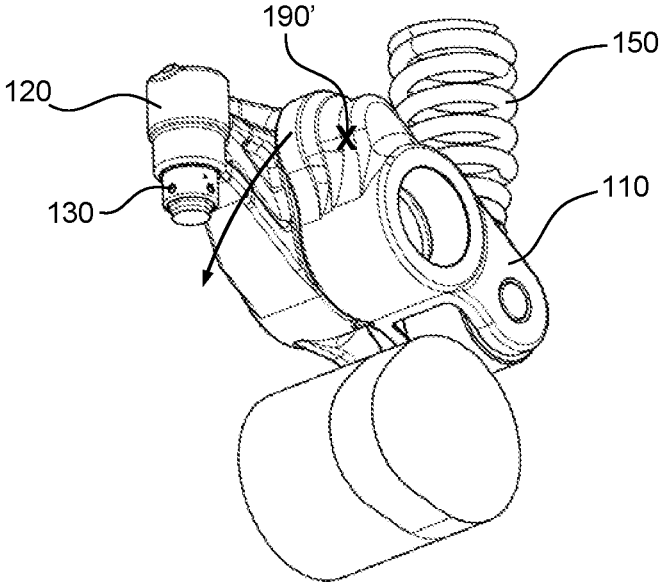
Figure 16 PRIOR ART
FIG. 16 is another perspective view of the prior art switchable rocker arm of FIG. 15.

FIG. 14 shows a switchable rocker arm assembly 12" with an optional adjusting screw assembly 70 used in place of the hydraulic lash adjuster assembly 26 as a valve interface. The implementation of the adjusting screw assembly 70 facilitates manual adjustment of lash between the engine valve (not shown in FIG. 14) and switchable rocker arm assembly 12".

In the foregoing description, example embodiments are described. The specification and drawings are accordingly to be regarded in an illustrative rather than in a restrictive sense. It will, however, be evident that various modifications and changes may be made thereto, without departing from the broader spirit and scope of the present invention.

In addition, it should be understood that the figures illustrated in the attachments, which highlight the functionality and advantages of the example embodiments, are presented for example purposes only. The architecture or construction of example embodiments described herein is sufficiently flexible and configurable, such that it may be utilized (and navigated) in ways other than that shown in the accompanying figures.

Although example embodiments have been described herein, many additional modifications and variations would be apparent to those skilled in the art. It is therefore to be understood that this invention may be practiced otherwise than as specifically described. Thus, the present example embodiments should be considered in all respects as illustrative and not restrictive.

What we claim is:

1. A switchable rocker arm comprising:

a valve lever assembly having:

a first rocker shaft bore at a first end;

a radial shuttle pin bore in fluid communication with the first rocker shaft bore; and, a first curved surface concentric with the first rocker shaft bore;

a cam lever assembly having:

a cam interface end;

a radial locking pin bore; and, a second curved surface rotationally guided by the first curved surface;

a coupling assembly, including a locking pin arranged to move longitudinally within the locking pin bore and a shuttle pin arranged to move longitudinally within the shuttle pin bore with a first end of the shuttle pin engaging a first end of the locking pin.

2. The switchable rocker arm of claim 1, further comprising a first rotational stop at a first end of the first curved surface and a second rotational stop configured within the valve lever assembly.

3. The switchable rocker arm of claim 2, wherein the second rotational stop is arranged at a first end of a third curved surface.

4. The switchable rocker arm of claim 1, further comprising:

a first arm and a second arm configured on the cam lever assembly, the two arms extending along opposed sides of the valve lever assembly; the first arm having a second rocker shaft bore and the second arm having a third rocker shaft bore;

wherein, the first rocker shaft bore is axially aligned with the second and third rocker shaft bores.

5. The switchable rocker arm of claim 1, further comprising a hydraulic lash adjuster assembly arranged at a second end of the valve lever assembly.

6. The switchable rocker arm of claim 5, further comprising at least one lost motion spring arranged between the cam lever assembly and the valve lever assembly, the at least one lost motion spring applying a force to the valve lever assembly that prevents pump-up of the hydraulic lash adjuster assembly while in a second, unlocked mode.

7. The switchable rocker arm of claim 1, further comprising an adjustment screw assembly arranged at a second end of the valve lever assembly.

8. The switchable rocker arm of claim 1, further comprising a roller follower arranged on the cam interface end of the cam lever assembly.

9. The switchable rocker arm of claim 1, having:

a first, locked position with the radial locking pin bore axially aligned with the radial shuttle pin bore, the locking pin arranged partially within the radial shuttle pin bore and partially within the radial locking pin bore; and, a second, unlocked position with the locking pin disengaged from the radial shuttle pin bore.

10. The switchable rocker arm of claim 9, including a spring in contact with the locking pin, the spring having a first compressed length in the first locked position and a second compressed length in the second unlocked position, wherein the first compressed length is greater than the second compressed length.

11. The switchable rocker arm of claim 9, wherein the first, locked position defines a full valve lift mode and the second, unlocked position defines a no valve lift mode.

12. The switchable rocker arm of claim 1, wherein the locking pin is configured with a first radial flat on an outer radial surface of the first end of the locking pin.

13. The switchable rocker arm of claim 12, wherein the shuttle pin bore is configured with a second radial flat to engage with the first radial flat.

14. The switchable rocker arm of claim 13, further comprising a shuttle pin sleeve disposed within the valve lever assembly to house the shuttle pin the shuttle pin sleeve configured with the second radial flat on an inner radial surface of the shuttle pin sleeve.

15. The switchable rocker arm of claim 14, wherein the shuttle pin is configured with a third radial flat on an outer radial surface of the shuttle pin.

16. The switchable rocker arm of claim 14, wherein the second radial flat extends from a first end of the shuttle pin sleeve to a medial position on the shuttle sleeve.

17. The switchable rocker arm of claim 12, wherein a locking pin landing having a convex quadrilateral cross-section is transversely disposed within the radial shuttle pin bore to receive the first radial flat.

18. The switchable rocker arm of claim 12, further comprising an anti-rotation restraint arranged within the valve lever assembly to engage the first radial flat.

19. The switchable rocker arm of claim 18, wherein the anti-rotation restraint is formed as a needle roller.

20. The switchable rocker arm of claim 19, wherein the anti-rotation restraint is transverse to the locking pin.

* * * * *